US005542648A

United States Patent [19]

Cohen

[11] Patent Number: 5,542,648

[45] Date of Patent: Aug. 6, 1996

[54] WIRE FENCING

[75] Inventor: Moshe H. Cohen, Givatayim, Israel

[73] Assignee: Yehuda Welded Mesh. Ltd., Israel

[21] Appl. No.: 217,253

[22] Filed: Mar. 24, 1994

[30] Foreign Application Priority Data

Mar. 28, 1993 [IL] Israel ..... 105187

[51] Int. Cl.[6] ..... E04H 17/02; F16S 3/08; B21F 29/00

[52] U.S. Cl. ..... 256/45; 256/33; 245/8; 245/9; 52/664

[58] Field of Search ..... 245/2, 4, 7–9; 140/7, 9; 256/45, 33, 32; D25/38, 39, 45; D5/54; 139/425 R, 425 A; 52/660, 664

[56] References Cited

U.S. PATENT DOCUMENTS

| | | | |
|---|---|---|---|
| 4,228 | 7/1870 | Jefford | D5/54 |
| 420,681 | 2/1890 | Gilbert | 256/45 X |
| 501,788 | 7/1893 | Horrocks | 245/2 |
| 763,736 | 6/1904 | Doppenschmitt | 245/9 |
| 949,668 | 2/1910 | Swinscoe | 256/45 X |
| 1,259,315 | 3/1918 | Tandy | 245/9 |
| 1,468,218 | 9/1923 | Storey | 256/2 |
| 2,125,583 | 8/1938 | Reed | 245/8 |
| 3,008,676 | 11/1961 | Scherfel | 245/9 |

FOREIGN PATENT DOCUMENTS

| | | | |
|---|---|---|---|
| 678832 | 1/1964 | Canada | 52/664 |
| 098328 | 1/1984 | European Pat. Off. . | |
| 172374 | 2/1952 | Germany | 256/33 |
| 1434716 | 11/1968 | Germany | 256/32 |
| 2225879 | 12/1973 | Germany . | |
| 104807 | 3/1917 | United Kingdom | 256/45 |

*Primary Examiner*—Anthony Knight
*Attorney, Agent, or Firm*—Fliesler, Dubb, Meyer & Lovejoy

[57] ABSTRACT

Wire fencing including a first multiplicity of wires lying in a first plane and extending in generally uniformly mutually spaced relationship and a second multiplicity of wires lying in a second plane adjacent to the first plane and extending in generally uniformly mutually spaced relationship in touching relationship with the first multiplicity of wires at a third multiplicity of intersection locations, the first and second multiplicities of wires being fixedly joined to each other at the third multiplicity of intersection locations, the first multiplicity of wires extending generally along mutually parallel first axes which are not perpendicular to second axes along which the second multiplicity of wires generally extend at a first group of the intersection locations.

10 Claims, 2 Drawing Sheets

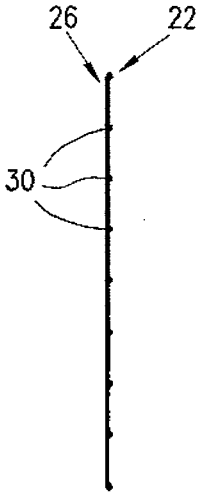
FIG.2B
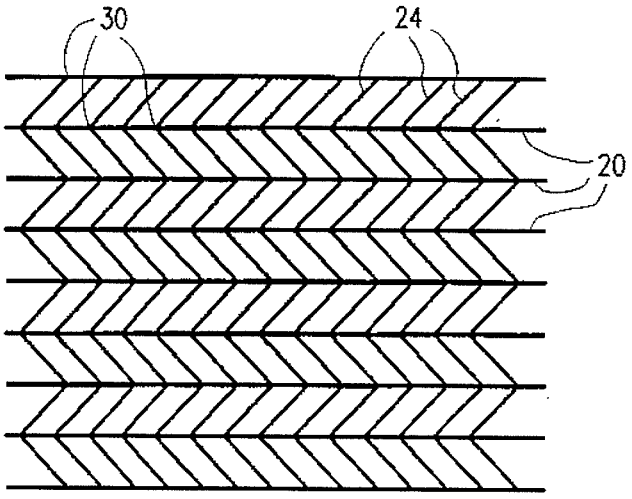
FIG.2A
FIG.3B
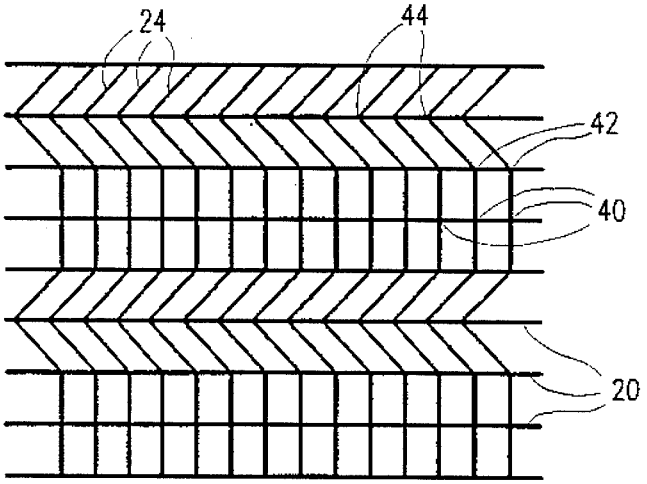
FIG.3A
FIG.4B
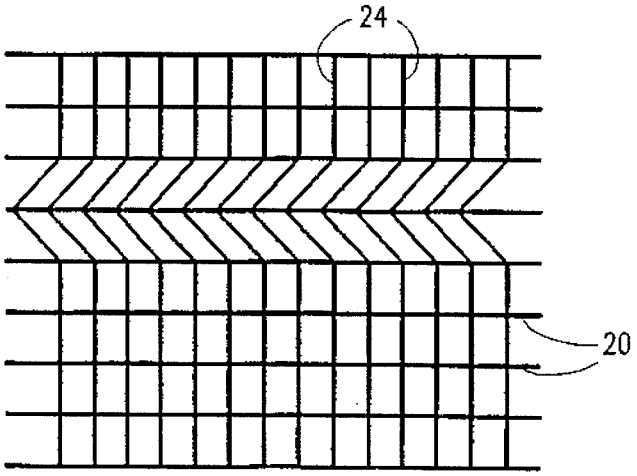
FIG.4A

WIRE FENCING

The present application claims priority to Israeli Patent Application Ser. No. 105,187 by Moshe H. Cohen, entitled "IMPROVED WIRE FENCING" which application was filed in the Israeli Patent Office on Mar. 28, 1993.

BACKGROUND OF THE INVENTION

1. Field of the Invention

The present invention relates to fencing generally and more particularly to wire fencing.

2. Description of the Related Art

A great variety of wire fencing is known in the art. The present applicants/assignees originated and presently market a welded wire fence having a three dimensional aspect, which greatly enhances its mechanical strength and also increases the difficulty of climbing the fence.

SUMMARY OF THE INVENTION

The present invention seeks to provide a new type of fencing which provides an optical illusion of three dimensionality, while being essentially planar and which, by virtue of its structure, is relatively difficult to climb.

There is thus provided in accordance with a preferred embodiment of the present invention wire fencing including a first multiplicity of wires lying in a first plane and extending in generally uniformly mutually spaced relationship and a second multiplicity of wires lying in a second plane adjacent to the first plane and extending in generally uniformly mutually spaced relationship in touching relationship with the first multiplicity of wires at a third multiplicity of intersection locations, the first and second multiplicities of wires being fixedly joined to each other at the third multiplicity of intersection locations, the first multiplicity of wires extending generally along mutually parallel first axes which are not perpendicular to second axes along which the second multiplicity of wires generally extend at a first group of the intersection locations.

In accordance with an embodiment of the invention the first multiplicity of wires extend generally along mutually parallel first axes which are perpendicular to second axes along which the second multiplicity of wires generally extend at a second group of the intersection locations.

In accordance with a preferred embodiment of the present invention, the first and second groups are arranged in strips which extend along the fencing from side to side, thereby creating a perceived three-dimensional zig-zag effect.

Preferably there exist third groups of intersection locations at which one of the wires is bent thereat such that three of the wire axes intersecting thereat extends at 90 degrees with respect to a wire adjacent thereto and a fourth wire extends at a non-90 degree angle with respect to the wires adjacent thereto. The third groups of intersection locations preferably are located in strips which separate the first groups from the second groups.

In accordance with a preferred embodiment of the present invention, in a given fence there may exist a plurality of second groups of intersection locations.

BRIEF DESCRIPTION OF THE DRAWINGS

The present invention will be understood and appreciated mope fully from the following detailed description, taken in conjunction with the drawings in which:

FIGS. 2A and 2B are respective side and edge view illustrations of fencing constructed and operative in accordance with a preferred embodiment of the present invention;

FIGS. 3A and 3B are respective side and edge view illustrations of fencing constructed and operative in accordance with another preferred embodiment of the present invention; and FIGS. 4A and 4B are respective side and edge view illustrations of fencing constructed and operative in accordance with still another preferred embodiment of the present invention.

DETAILED DESCRIPTION OF A PREFERRED EMBODIMENT

Figure 1:
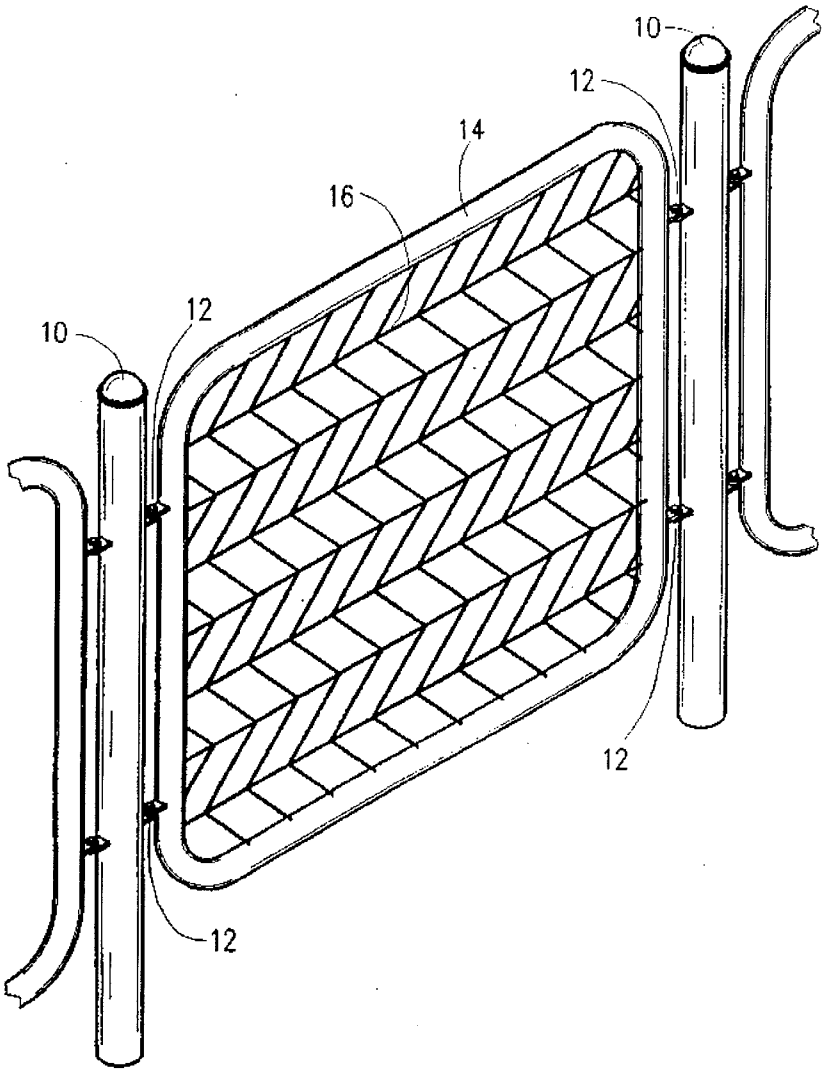
FIG. 1 is a pictorial illustration of a fence constructed and operative in accordance with a preferred embodiment of the present invention.

Reference is now made to FIG. 1, which illustrates a fence constructed and operative in accordance with a preferred embodiment of the present invention. The fence preferably comprises a plurality of fence posts 10, spaced one from the other, to which are attached, as by hinge elements 12, fence frames 14.

Mounted on the fence frames 14 by any suitable technique are sections of generally planar fencing 16 having a zig-zag configuration which has a three-dimensional appearance.

Referring now additionally to FIGS. 2A and 2B, it is seen that the fencing 16 comprises a first multiplicity of wires 20 lying in a first plane indicated by an arrow 22 and extending in generally uniformly mutually spaced relationship and a second multiplicity of wires 24, lying in a second plane, indicated by an arrow 26, adjacent to the first plane.

The second plurality of wires 24 extend in generally uniformly mutually spaced relationship in touching relationship with the first multiplicity of wires at a third multiplicity of intersection locations, indicated generally by reference numeral 30.

In accordance with a preferred embodiment of the present invention, the first and second multiplicities of wires 20 and 24 are fixedly joined to each other at the third multiplicity of intersection locations 30.

In the embodiment illustrated in FIGS. 1 and 2A, at intersection locations 30, the first multiplicity of wires 20 extend generally along mutually parallel first axes which are not perpendicular to second axes along which the second multiplicity of wires generally extend.

Referring now to FIGS. 3A and 3B, it is seen that here there are defined three different types of intersection locations. At a first type of intersection locations 40, the first and second multiplicities of wires 20 and 24 meet in mutually perpendicular relationship.

At a second type of intersection locations 42, one of the wires is bent thereat such that three of the wires intersecting thereat extend at 90 degrees with respect to a wire adjacent thereto and a fourth wire extends at a non-90 degree angle with respect to the wires adjacent thereto.

At a third type of intersection locations 44, wires of the first plurality 20 extend straight through the intersection locations, while wires of the second plurality 24 are bent thereat and arranged so that both wires of the second plurality are inclined with respect to each other and with respect to the wires of the first plurality 20 at the intersection location.

In accordance with a preferred embodiment of the present invention, the first, second and third types of intersection locations are grouped and arranged in strips which extend along the fencing from side to side, thereby creating a perceived three-dimensional zig-zag effect.

Normally the strips of the third type are separated from the strips of the first type by strips of the first type as illustrated.

In accordance with a preferred embodiment of the present invention, in a given fence there may exist a plurality of strips of third types of intersection locations, as shown in FIGS. 2A and 3A. Alternatively, as shown in FIGS. 4A and 4B, only a single strip of third types of intersection location, bounded by strips of the second type of intersection locations may be provided.

It will be appreciated by persons skilled in the art that the present invention is not limited by what has been particularly shown and described hereinabove. Rather the scope of the present invention is defined only by the claims which follow.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

We claim:

1. Wire fencing comprising:

a first multiplicity of wires lying in a first plane and extending in generally uniformly mutually spaced relationship and a second multiplicity of wires lying in a second plane adjacent to said first plane and extending in generally uniformly mutually spaced relationship in touching relationship with said first multiplicity of wires at a third multiplicity of intersection locations, said first and said second multiplicities of wires being fixedly joined to each other at said third multiplicity of intersection locations, said first multiplicity of wires extending generally along mutually parallel first axes which are not perpendicular to second axes along which said second multiplicity of wires generally extend at a first group of the intersection locations;

wherein said first multiplicity of wires extend generally along mutually parallel first axes which are perpendicular to second axes along which said second multiplicity of wires generally extend at a second group of said intersection locations; and wherein said first and second groups are arranged in strips which extend along the fencing from side to side, thereby creating a perceived three-dimensional zig-zag effect.

2. Wire fencing according to claim 1 and also comprising a third group of intersection locations at which one of the wires is bent thereat such that three of the wire axes intersecting thereat extends at 90 degrees with respect to a wire adjacent thereto and a fourth wire extends at a non-90 degree angle with respect to the wires adjacent thereto.

3. Wire fencing according to claim 2 and wherein said third group of intersection locations preferably is located in strips which separate the first groups from the second groups.

4. Wire fencing according to claim 3 and comprising a plurality of second groups of intersection locations.

5. Wire fencing according to claim 2 and comprising a plurality of second groups of intersection locations.

6. Wire fencing according to claim 1 and also comprising a third group of intersection locations at which one of the wires is bent thereat such that three of the wire axes intersecting thereat extends at 90 degrees with respect to a wire adjacent thereto and a fourth wire extends at a non-90 degree angle with respect to the wires adjacent thereto.

7. Wire fencing according to claim 6 and wherein said third group of intersection locations preferably is located in strips which separate the first groups from the second groups.

8. Wire fencing according to claim 7 and comprising a plurality of second groups of intersection locations.

9. Wire fencing according to claim 6 and comprising a plurality of second groups of intersection locations.

10. Wire fencing according to claim 1 and comprising a plurality of second groups of intersection locations.

* * * * *